US007557755B2

(12) United States Patent
Han et al.

(10) Patent No.: US 7,557,755 B2
(45) Date of Patent: Jul. 7, 2009

(54) ULTRA WIDEBAND ANTENNA FOR FILTERING PREDETERMINED FREQUENCY BAND SIGNAL AND SYSTEM FOR RECEIVING ULTRA WIDEBAND SIGNAL USING THE SAME

(75) Inventors: Sang-min Han, Hwaseong-si (KR); Young-hwan Kim, Hwaseong-si (KR); Seong-soo Lee, Suwon-si (KR); Hyung-kuk Yoon, Goyang-si (KR); Young-joong Yoon, Seoul (KR); Yo-han Lim, Anyang-si (KR); Ick-jae Yoon, Seoul (KR); Hyung-rak Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 375 days.

(21) Appl. No.: 11/365,849

(22) Filed: Mar. 2, 2006

(65) Prior Publication Data

US 2006/0208954 A1 Sep. 21, 2006

(30) Foreign Application Priority Data

Mar. 2, 2005 (KR) ..... 10-2005-0017287
Dec. 23, 2005 (KR) ..... 10-2005-0128930

(51) Int. Cl.
*H01Q 1/38* (2006.01)

(52) U.S. Cl. ..... 343/700 MS; 343/767

(58) Field of Classification Search ..... 343/700 MS, 343/767–769, 829–830, 846–848
See application file for complete search history.

(56) References Cited

U.S. PATENT DOCUMENTS 5,557,291 A * 9/1996 Chu et al. ..... 343/725
5,748,153 A * 5/1998 McKinzie et al. ..... 343/767
5,828,340 A * 10/1998 Johnson ..... 343/700 MS
6,496,155 B1 * 12/2002 Sievenpiper et al. ..... 343/770
6,914,573 B1 * 7/2005 McCorkle ..... 343/767
7,116,267 B2 * 10/2006 Schuster et al. ..... 342/174
7,132,985 B2 * 11/2006 Lin ..... 343/700 MS
7,292,190 B2 * 11/2007 Teng et al. ..... 343/700 MS
7,352,333 B2 * 4/2008 McCorkle ..... 343/767

FOREIGN PATENT DOCUMENTS

KR 10-0636374 B1 10/2006

* cited by examiner

*Primary Examiner*—Huedung Mancuso
(74) *Attorney, Agent, or Firm*—Sughrue Mion, PLLC

(57) ABSTRACT

An ultra wideband antenna is provided that filters a predetermined frequency signal. The ultra wideband antenna includes a power feeding part that receives a supply of an external electromagnetic energy; a radiator excited by the electromagnetic energy fed through the power feeding part and radiating an electromagnetic wave; and a stub, provided on the radiator in a direction parallel to a direction of an electric field formed by the electromagnetic wave, that intercepts transmission/reception of a predetermined frequency band signal. The length of the stub may be ¼ of a wavelength of the intermediate frequency of the predetermined frequency band to be removed to filter the corresponding frequency band signal. The ultra wideband antenna simplifies the construction of an ultra wideband receiving system with the power loss and noise characteristics of the system improved.

15 Claims, 10 Drawing Sheets

ULTRA WIDEBAND ANTENNA FOR FILTERING PREDETERMINED FREQUENCY BAND SIGNAL AND SYSTEM FOR RECEIVING ULTRA WIDEBAND SIGNAL USING THE SAME

This application claims priority from Korean Patent Application No. 10-2005-0017287, filed on Mar. 2, 2005 and Korean Patent Application No. 10-2005-0128930, filed on Dec. 23, 2005, in the Korean Intellectual Property Office, the disclosure of which is incorporated herein by reference.

BACKGROUND OF THE INVENTION

1. Field of the Invention

Apparatuses consistent with the present invention relate to an ultra wideband antenna, and more particularly to an ultra wideband antenna that intercepts transmission/reception of a predetermined frequency band signal using a radiator with a stub having a length of λ/4 inserted thereto.

2. Description of the Related Art

All antennas are used to convert an electric signal into a specified electromagnetic wave to radiate the converted electromagnetic wave to free space, or to convert a received electromagnetic wave into an electric signal. Ultra wideband (UWB) technology refers to a wireless transmission technology that directly transmits and receives an impulse signal without using an RF carrier. An ultra wideband antenna is an antenna that can transmit and receive an impulse signal using a frequency band in the range of 3.1 to 10.6 GHz.

Ultra wideband technology can achieve a high-speed data transmission using an ultra low power due to the use of a very wide frequency band, unlike the existing narrow-band communication method. Accordingly, ultra wideband can be applied to a home networking application such as a wireless personal area network (WPAN), which has become increasingly popular.

FIG. 1 is a block diagram illustrating the construction of a conventional receiving system using an ultra wideband antenna. Referring to FIG. 1, the conventional receiving system includes an ultra wideband antenna 10, a filter unit 20, a matching unit 30 and an amplifying unit 40.

The ultra wideband antenna 10 receives signals in the frequency range of 3.1~10.6 GHz.

The filter unit 20 removes signals in the frequency range of 5.15~5.825 GHz among the signals received from the ultra wideband antenna 10. The frequency band of 5.15~5.825 GHz has also been used in the wireless LAN (WLAN) communication service standard (e.g., HIPERLAN/2, IEEE 802.11a).

As a result, the frequency band of 5.15~5.825 GHz may cause interference with WLAN signals, and thus the system removes signals in this frequency band using the filter unit 20. For this, the filter unit 20 may be implemented by a notch filter that passes only the remaining signals except for a predetermined frequency band.

The matching unit 30 matches the impedance of the antenna to the impedance of a power feeding cable (not illustrated). The amplifying unit 40 amplifies the received signal and outputs the amplified signal to the following circuit. Detailed explanation of other constituent elements of the receiving system will be omitted.

In the conventional receiving system as described above, the ultra wideband antenna 10 and the filter unit 20 have been implemented as separate circuits, and this causes the entire size of the receiving system to be increased. Also, since many constituent elements exist in the receiving system, the power loss is great and the system construction is complicated. Accordingly, research of an ultra wideband antenna having a filter function capable of removing signals in a predetermined frequency band has been proposed.

SUMMARY OF THE INVENTION

The present invention has been developed in order to solve the above drawbacks and other problems associated with the conventional arrangement. An aspect of the present invention provides an ultra wideband antenna that can remove a predetermined frequency band signal by providing a radiator with a stub having a length of λ/4 inserted thereto.

Another aspect of the present invention provides a system for receiving an ultra wideband signal that is small-sized and has improved power loss and noise characteristics by using an antenna receiving ultra wideband signals except for a predetermined frequency band signal.

In order to achieve the above and other aspects of the present invention, an ultra wideband antenna is provided, according to a first exemplary embodiment of the present invention, which includes a power feeding part which receives a supply of an external electromagnetic energy; a radiator which is excited by the electromagnetic energy fed through the power feeding part and radiating an electromagnetic wave; and a stub, disposed on the radiator in a direction which is parallel to a direction of an electric field of the electromagnetic wave which is radiated, which intercepts transmission or reception of a predetermined frequency band signal.

The radiator may include a substrate, a first metal layer disposed on the substrate, a second metal layer disposed on the substrate, and a taper slot, disposed on the substrate such that the taper slot gradually widens in a radiation direction of the electromagnetic wave, which divides the first metal layer and the second metal layer from each other. The first metal layer and the second metal layer may be deposited on the substrate and the taper slot formed on the substrate to divide the first metal layer and the second metal layer.

The stub may include a first stub disposed on the first metal layer, which includes one end that is open in a direction of the taper slot, and a length of ¼ wavelength of an intermediate frequency signal in the predetermined frequency band, and a second stub disposed on the second metal layer, which includes one end that is open in a direction of the taper slot, and a length of a ¼ wavelength of an intermediate frequency signal in the predetermined frequency band.

The power feeding part may include a lower feeding part, disposed on a lower surface of the substrate, which receives the supply of the electromagnetic energy, and an upper feeding part, which is provided as a pattern in a predetermined shape of the first metal layer and the second metal layer, which couples the electromagnetic energy. The lower feeding part may be formed on the lower surface of the substrate and the upper feeding part may be formed in the first metal layer and the second metal layer as a pattern in the predetermined shape.

The power feeding part may include a multi-arm structure in which the lower feeding part and the upper feeding part have a plurality of branches, respectively.

According to a second exemplary embodiment of the present invention, the radiator may include a substrate, a metal layer, disposed on the substrate in a circular shape, which omnidirectionally radiates the electromagnetic wave, and a coplanar waveguide (CPW) line which transfers the electromagnetic energy coupled by the power feeding part to the metal layer.

The stub may include a first stub disposed on a left side of the metal layer with respect to the CPW line, said first stub having a length of ¼ wavelength of an intermediate frequency signal in the predetermined frequency band, and a second stub disposed on a right side of the metal layer with respect to the CPW line, said second stub having a length of a ¼ wavelength of an intermediate frequency signal in the predetermined frequency band.

According to a third exemplary embodiment of the present invention, the radiator includes a substrate, and a metal layer disposed on an edge of an upper surface of the substrate such that a predetermined area of the upper surface of the substrate is exposed to provide a hole.

The power feeding part may be disposed on a lower surface of the substrate.

The metal layer may be connected to an external ground terminal and if the electromagnetic energy is supplied via the power feeding part, the metal layer may radiate the electromagnetic energy via the hole.

The stub may include a first stub disposed in the hole of the substrate, wherein a first end of the first stub contacts the metal layer and a second end of the first stub is open in a direction inward of the hole, and a second stub disposed in the hole of the substrate, wherein a first end of the second stub contacts the metal layer and a second end of the second stub is open in a direction inward of the hole and parallel with the first stub. The first and the second stubs may have lengths of a ¼ wavelength of a intermediate frequency signal in the predetermined frequency band, respectively.

The power feeding part may include a first power feeding part disposed on a central area of the lower surface of the substrate and having a multi-arm structure, and a second power feeding part which extends from an edge to the central area of the lower surface of the substrate so as to connect to the first power feeding part.

According to another aspect of the present invention, a system is provided for receiving an ultra wideband signal, which includes an antenna which receives an ultra wideband signal except for a predetermined frequency band signal within an ultra wideband frequency range; a matching unit which matches an impedance of the antenna to a predetermined level; and an amplifying unit which amplifies the signals which are received through the antenna.

The antenna may include a radiator which radiates an electromagnetic wave in a predetermined direction, and at least one stub provided on the radiator in a direction parallel to a direction of an electric field of the electromagnetic wave, and having a length of a ¼ wavelength of a intermediate frequency signal in the frequency band.

BRIEF DESCRIPTION OF THE DRAWINGS

The above and other aspects and features of the present invention will become more apparent by describing certain exemplary embodiments of the present invention with reference to the accompanying drawings, in which.

DETAILED DESCRIPTION OF THE EXEMPLARY EMBODIMENTS OF THE INVENTION

Figure 1:
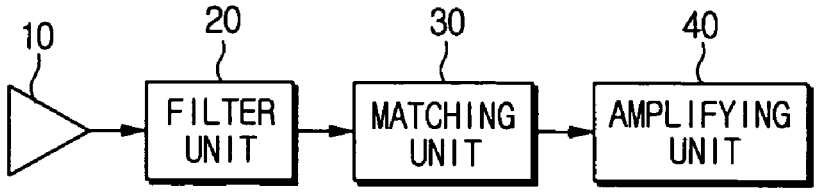
FIG. 1 (PRIOR ART)
FIG. 1 is a block diagram illustrating the construction of a conventional receiving system using an ultra wideband antenna.

Exemplary embodiments of the present invention will be described in detail with reference to the accompanying drawings. In the drawings, the same elements are denoted by the same reference numerals throughout the drawings. In the following description, detailed descriptions of known functions and configurations incorporated herein have been omitted for conciseness and clarity.

Figure 2:
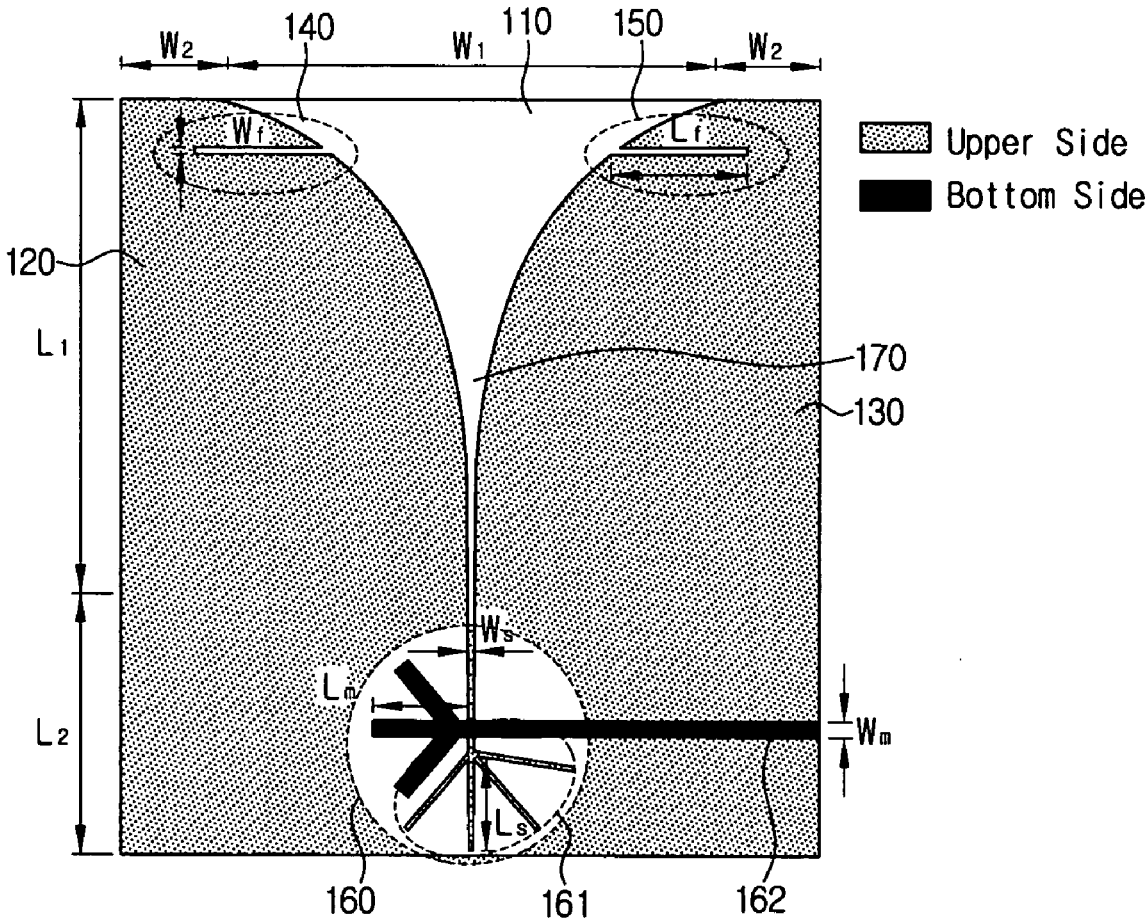
FIG. 2 is a view illustrating the structure of an ultra wideband antenna according to a first exemplary embodiment of the present invention.

FIG. 2 is a view illustrating the structure of an ultra wideband antenna according to a first exemplary embodiment of the present invention. Referring to FIG. 2, the ultra wideband antenna according to the first exemplary embodiment of the present invention includes a substrate 110, a first metal layer 120, a second metal layer 130, a first stub 140, a second stub 150, a power feeding part 160 and a taper type slot 170.

The substrate 110 may be a typical dielectric substrate.

On the upper surface of the substrate 110, the first metal layer 120 and the second metal layer 130 are deposited. The first and second metal layers 120 and 130 are divided from each other on the basis of the taper type slot 170. The taper type slot 170 has a shape in that it is gradually widened in one direction. The first and second metal layers 120 and 130 and the taper type slot 170 serves as a radiator that radiates an electromagnetic wave in a predetermined direction.

The power feeding part 160 receives a supply of an external electromagnetic energy and transfers the received energy to the radiator. For this, the power feeding part 160 includes an upper feeding part 161 and a lower feeding part 162. The lower feeding part 162 is formed on the lower surface of the substrate with a predetermined conduction material, and is connected to an external terminal to receive the supply of the electromagnetic energy from the external terminal.

On the other hand, the upper feeding part 161 is formed by removing the first and second metal layers 120 and 130 deposited on the upper surface of the substrate in a predetermined pattern. This upper feeding part 161 couples the electromagnetic energy applied to the lower feeding part 162, and transfers the coupled electromagnetic energy to the taper type slot 170.

The electromagnetic energy transferred to the taper type slot 170 is converted into a radio electromagnetic wave at the right end part of the taper type slot 170 to be radiated from the taper type slot 170. The radiation direction of the electromagnetic wave is the same direction in which the taper type slot 170 is widened.

The power feeding part 160 may have a multi-arm structure. That is, one end of the lower feeding part 162 splits into a plurality of branches, and the upper feeding part 161 also splits into a plurality of branches by patterning the first and second metal layers 120 and 130. This structure can transmit/receive the ultra wideband signal.

The first and second stubs 140 and 150 are formed on the first and second metal layers 120 and 130, respectively. In this case, the length of the first and second stubs becomes a ¼ wavelength. In addition, the first and second stubs 140 and 150 are formed in parallel to the direction of the electric field formed by the electromagnetic wave, and one end of the first and second stubs 140 and 150 is open in a direction toward the taper type slot 170.

In FIG. 2, the radiation direction is upward, and the direction of the electric field is perpendicular to the radiation direction. The wavelength may be expressed by Equation (1).

$$\lambda_g = \frac{c}{f\sqrt{\varepsilon_r}} \qquad \text{Equation (1)}$$

In Equation (1), $\lambda_g$ denotes a wavelength, f denotes the intermediate frequency of the frequency band to be removed, c denotes the velocity of light, and $\in_r$ is a dielectric constant. The first and second stubs 140 and 150 formed inside the radiator can remove the predetermined frequency band signal by intercepting the flow of the electromagnetic energy of the corresponding frequency band.

The first and second metal layers 120 and 130, the first and second stubs 140 and 150, the upper feeding part 161 and the taper type slot 170, which constitute the ultra wideband antenna of FIG. 2, may be formed by depositing a metal layer on the upper surface of the substrate and then patterning the deposited metal layer.

Figure 3:
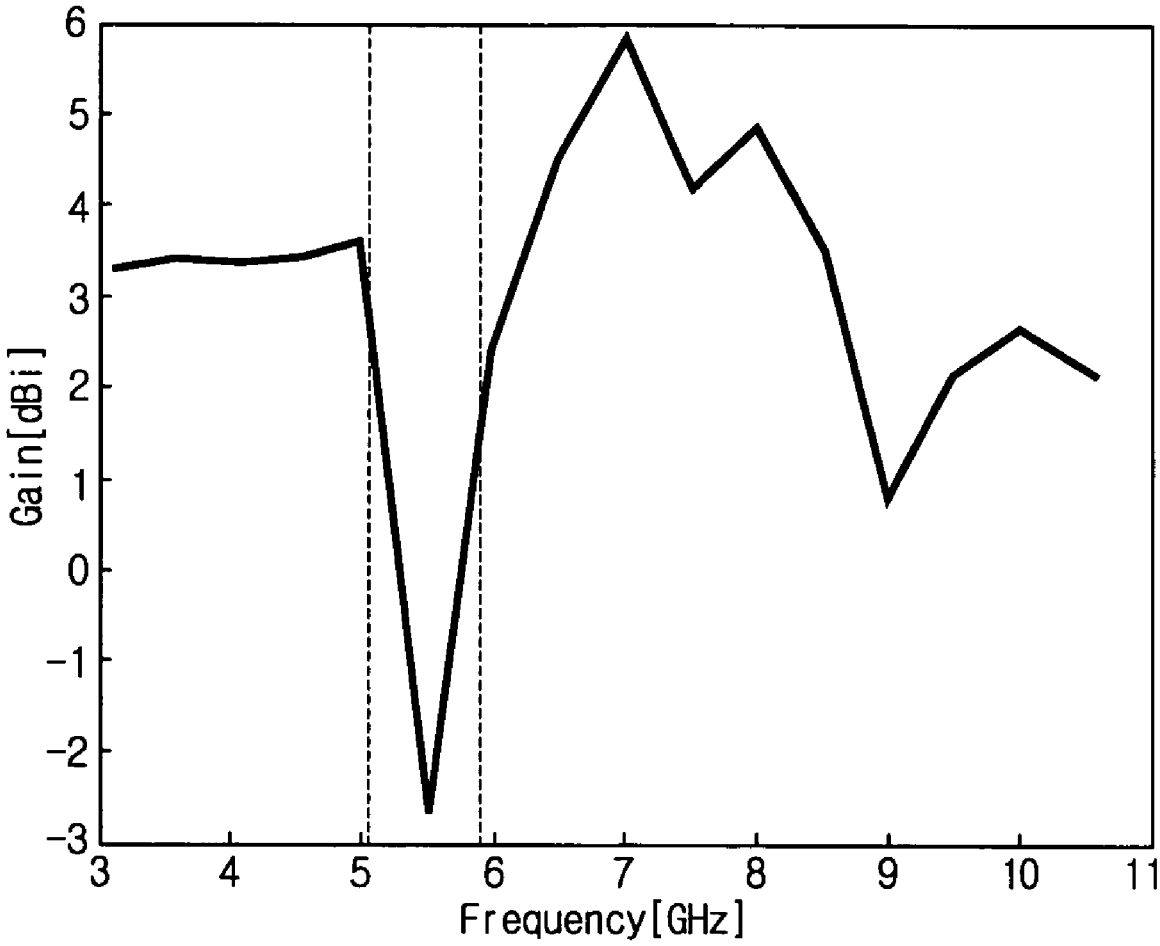
FIG. 3 is a graph illustrating the gain characteristic of the ultra wideband antenna of FIG. 2.
Figure 4:
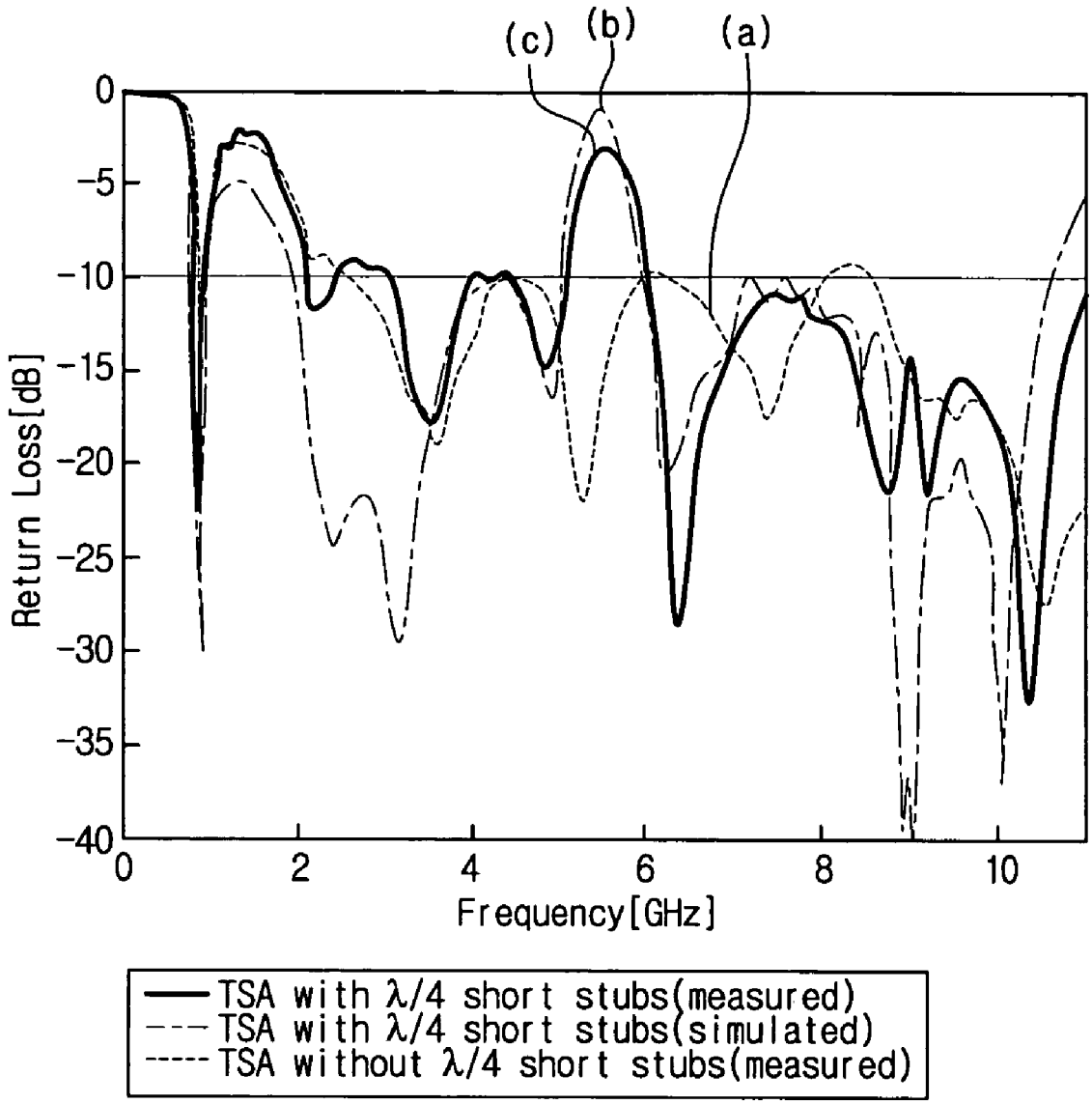
FIG. 4 is a graph illustrating the return-loss characteristic of the ultra wideband antenna of FIG. 2.

On the other hand, the results of experiments under the condition that W1, W2, L1, L2, $W_m$, $L_m$, $W_s$ and $L_s$ defined as illustrated in FIG. 2 are set to 37 mm, 6.5 mm, 35 mm, 20 mm, 1.13 mm, 5.06 mm, 0.26 mm and 6.8 mm, respectively, are illustrated in FIGS. 3 and 4.

FIG. 3 is a graph illustrating the gain characteristic of the ultra wideband antenna of FIG. 2. Referring to FIG. 3, it can be seen that the gain falls to 2.7 dBi in the frequency band of 5~6 GHz. This is because the frequency signal in the frequency band of 5~6 GHz is intercepted by the first and second stubs 140 and 150.

FIG. 4 is a graph illustrating the return-loss characteristic of the ultra wideband antenna of FIG. 2. The return-loss characteristic of the conventional ultra wideband antenna having no stub is shown as graph (a). According to graph (a), the return loss is less than −10 dB in the frequency band of 2~10 GHz. That means that the conventional ultra wideband antenna receives the whole ultra wideband signal.

By contrast, the return-loss characteristic according to the experimental results of the simulation of the ultra wideband antenna having the first and second stubs 140 and 150 is shown as graph (b). According to graph (b), the return loss is more than −10 dB and approaches 0 dB. This means that the signal in the frequency band of 5~6 GHz is intercepted.

Also, the return-loss characteristic according to the results of an actual experiment using the ultra wideband antenna according to an exemplary embodiment of the present invention is shown as graph (c). According to graph (c), it can bee seen that the signal in the frequency band of 5~6 GHz is intercepted.

Figure 5:
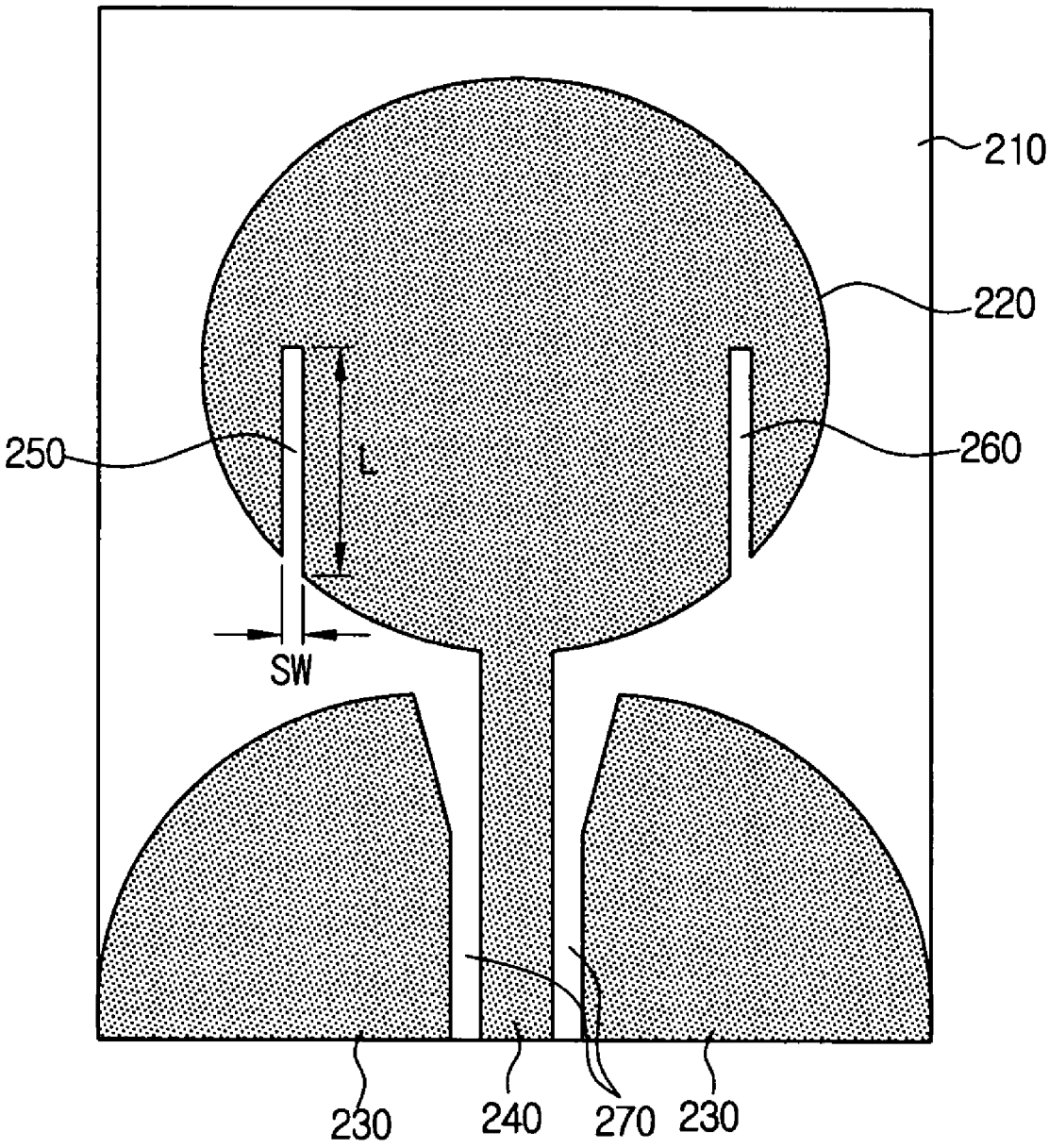
FIG. 5 is a view illustrating the structure of an ultra wideband antenna according to a second exemplary embodiment of the present invention.

FIG. 5 is a view illustrating the structure of an ultra wideband antenna according to a second exemplary embodiment of the present invention. The ultra wideband antenna of FIG. 5 includes a substrate 210, a metal layer 220, a power feeding part 230 and a CPW line 240.

The power feeding part 230 receives an external electromagnetic energy.

The CPW line is formed at intervals of a predetermined slot 270 between both sides of the power feeding part 230. The CPW line couples the electromagnetic energy received from the power feeding part 230 and transfers the coupled electromagnetic energy to the metal layer 220.

The metal layer 220 converts the electromagnetic energy transferred through the CPW line 240 into an electromagnetic wave and radiates the converted electromagnetic wave. In this case, the metal layer 220 is formed in the shape of a circle on the substrate 210, and has an omnidirectional radiation pattern. That is, the substrate 210, the metal layer 220 and the CPW line 240 operate as a radiator.

First and second stubs 250 and 260 are formed on the left and right sides of the CPW line 240, respectively. The first and second stubs 250 and 260 have a length of λ/4, respectively. Here, λ refers to a wavelength that corresponds to the intermediate frequency of the frequency band to be removed.

The first and second stubs 250 and 260 are formed in a direction parallel to an electric field forming direction. That is, since the electric field is formed in upper and lower directions, the first and second stubs 250 and 260 are also formed in upper and lower directions.

In FIG. 5, the width and length of the stub differ according to the width of the frequency band to be removed and its intermediate frequency. That is, if the width SW of the stubs 250 and 260 is increased, the width of the frequency band to be remove is also increased. If the length L of the stubs 250 and 260 is increased, the size of the intermediate frequency is also increased. Accordingly, by adjusting the width and length of the stubs 250 and 260, the frequency band to be removed can be tuned.

Figure 6A:
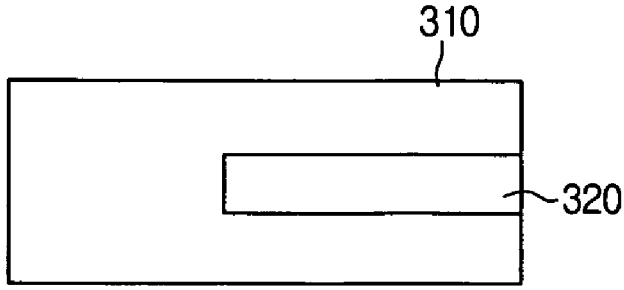
FIGS. 6A and 6B are views illustrating examples of a stub for use in the ultra wideband antenna according to an exemplary embodiment of the present invention.
Figure 6B:
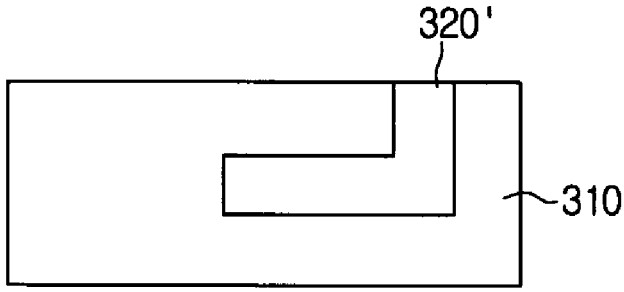

FIGS. 6A and 6B are views illustrating stubs formed in the radiator part of the ultra wideband antenna according to an exemplary embodiment of the present invention.

In FIG. 6A, a stub 320 is formed on the radiator 310 in the form of a bar. The stub structure of FIG. 6A is illustrated in FIGS. 2 and 5.

In FIG. 6B, a stub 320' is formed on the radiator 310 in the form of "ㄱ" or "ㄴ". This stub structure can be optionally selected according to the position of the stub on the radiator.

Figure 7:
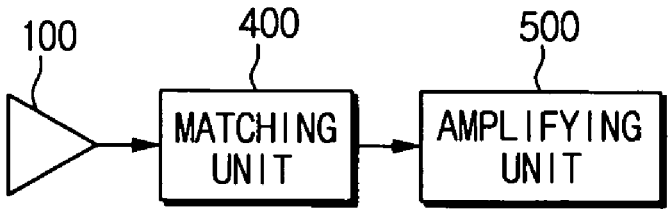
FIG. 7 is a block diagram illustrating the construction of a system for receiving an ultra wideband signal according to an exemplary embodiment of the present invention.

FIG. 7 is a block diagram illustrating the construction of a system for receiving an ultra wideband signal according to an exemplary embodiment of the present invention.

Referring to FIG. 7, the system for receiving an ultra wideband signal according to an exemplary embodiment of the present invention includes an ultra wideband antenna 100, a matching unit 400 and an amplifying unit 500.

The ultra wideband antenna 100 is formed to have the structure as illustrated in FIG. 2 or 5, and thus it has even a filter function that intercepts the predetermined frequency band signal.

The matching unit 400 matches the impedance of the ultra wideband antenna 100 to a predetermined level. That is, the matching unit 400 matches the impedance of the antenna 100 to the same level as the impedance of the power feeding cable.

The amplifying unit 500 amplifies the signals received through the ultra wideband antenna 100. The amplifying unit 500 may be implemented by a low noise amplifier.

As the ultra wideband antenna 100 itself has a filter function, the system for receiving the ultra wideband signal according to an exemplary embodiment of the present invention does not require a separate filter. Accordingly, the structure of the whole system is simplified in comparison to the structure as illustrated in FIG. 1.

Figure 8:
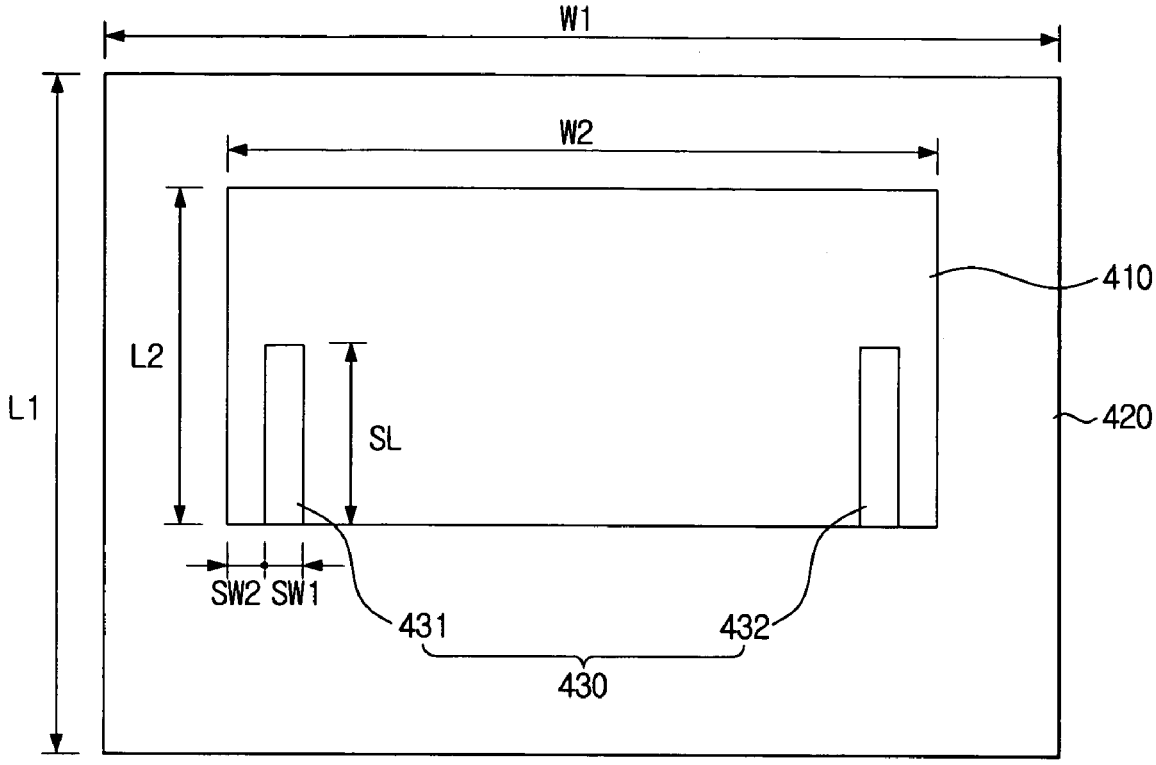
FIG. 8 is a front view of an ultra wideband antenna according to a third exemplary embodiment of the present invention.
Figure 9:
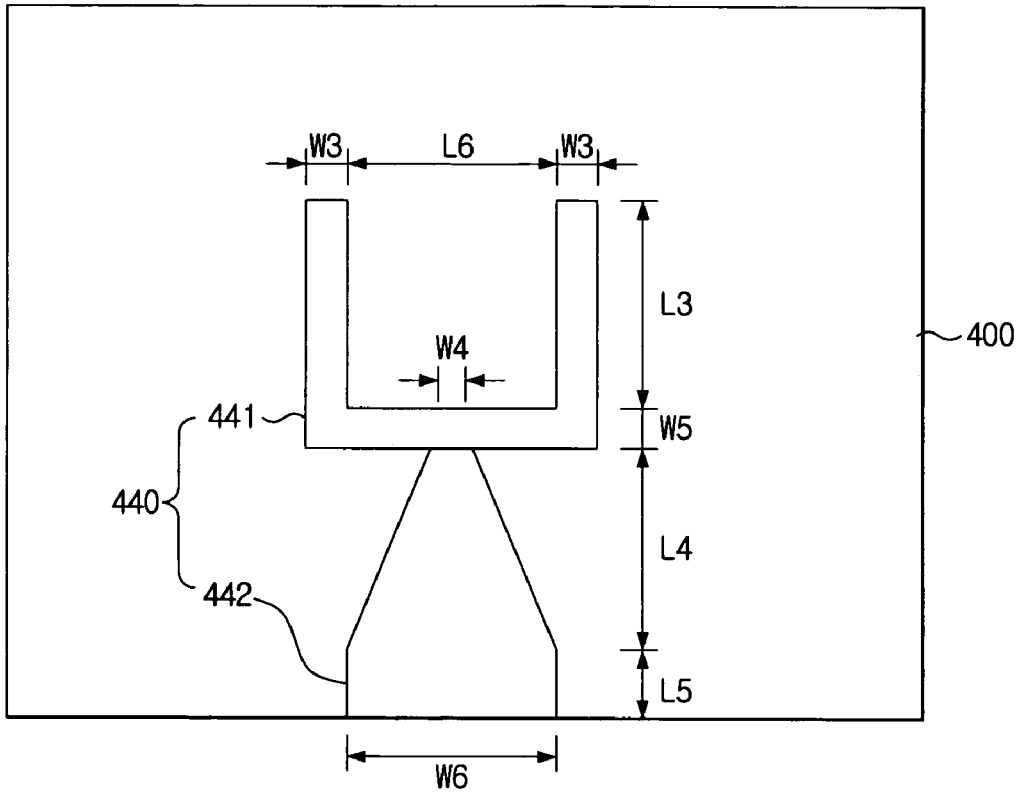
FIG. 9 is a rear view of an ultra wideband antenna according to a third exemplary embodiment of the present invention.

FIGS. 8 through 9 are views of the structure of an ultra wideband antenna according to a third exemplary embodiment of the present invention. Referring to FIGS. 8 and 9, the ultra wideband antenna according to the third exemplary embodiment of the present invention includes a power feeding part 440, a substrate 400, a metal layer 420, a hole 410 and a stub 430.

FIG. 8 is a view of a front of the ultra wideband antenna according to the third exemplary embodiment of the present invention. Referring to FIG. 8, the metal layer 420, the hole 410 and the stub 430 are disposed on the front of the ultra wideband antenna. The hole 410 is an area of the substrate 400 on which the metal layer 420 is not deposited. In other words, the metal layer 420 is formed at an edge of a surface of the substrate 400, and the substrate 400 portion is exposed at a predetermined area of the metal layer 420 to form the hole 410. Referring to FIG. 8, the hole 410 is configured as a rectangle and formed in a central area of the substrate 400. However, this configuration should not be considered as limiting. The shape, size and position may be varied according to other exemplary embodiments of the present invention for design purposes.

As a ground terminal is connected to the metal layer 420 and power is fed to the power feeding part 440, an electromagnetic wave is radiated in the hole 410 area. In other words, the substrate 400, the metal layer 420 and the hole 410 serve as a radiator. The electromagnetic wave is radiated perpendicularly to the surface of the hole 410.

The stub 430 comprises a first stub 431 and a second stub 432. Both of the first stub 431 and the second stub are formed in the hole 410. Additionally, the length of each stub 431, 432 is designed to have a length of a ¼ wavelength of a intermediate frequency signal. The number and position of the stub 430 may be varied according to exemplary embodiments of the present invention. In other words, referring to FIG. 8, the first and the second stubs 431, 432 are provided in the quantity of only two and positioned at a lower side in the hole 410. However, the stub may be provided in the quantity of one, or three or more and positioned at an upper side in the hole 410 as well as the lower side.

FIG. 9 is a view of a rear of an ultra wideband antenna according to a third exemplary embodiment of the present invention. Referring to FIG. 9, the power feeding part 440 is disposed at the rear of the ultra wideband antenna. The power feeding part 440 includes a first power feeding part 441 and a second power feeding part 442.

The first power feeding part 441 is positioned in a central area of the rear of the substrate 400. The second power feeding part 442 is formed to connect an edge area with the central area of the rear of the substrate 400 so as to connect to the first power feeding part 441. Accordingly, the second power feeding part 442 is connected to an external terminal so as to feed the electromagnetic energy to the first power feeding part 441. Under this circumstance, if the metal layer 420 of the front of the substrate 400 is grounded, the electromagnetic energy fed to the first power feeding part 441 is passed and coupled so as to radiate via the hole 410 in an electromagnetic wave form. At this time, a predetermined frequency band signal is cut-off by the stub 430.

Referring to FIG. 9, the first power feeding part 441 is formed in a multi-arm structure with two arms. In particular, the first power feeding part 441 is configured as a ⊔ form. However, this should not be considered as limiting. The first power feeding part 441 may be configured as various multi-arm structures, such as a ⊔⊔ form or a ⊥form.

Figure 10:
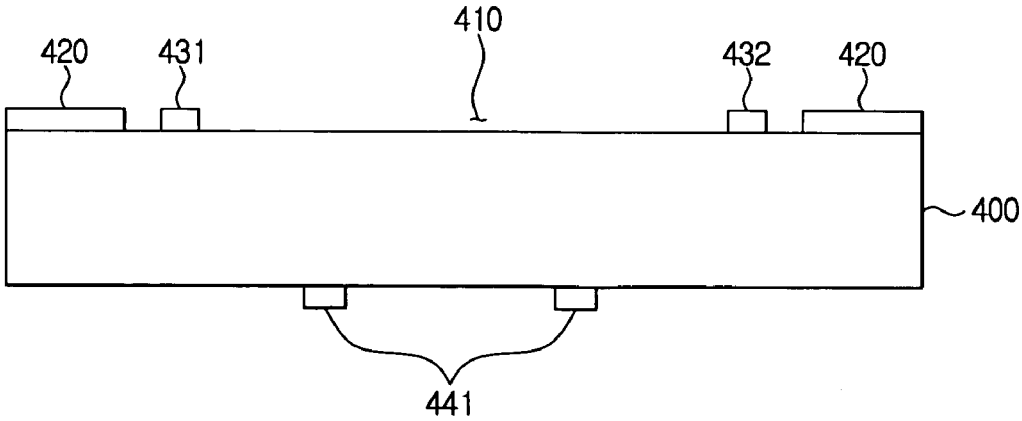
FIG. 10 is a vertical sectional view of an ultra wideband antenna according to a third exemplary embodiment of the present invention.

FIG. 10 is a cross-sectional view of an ultra wideband antenna according to a third exemplary embodiment of the present invention. Referring to FIG. 10, the ultra wideband antenna includes a radiator and the power feeding part 440 at a front and a rear of the substrate 400. The distance between the two arms of the first power feeding part 441 is shorter than the distance between the first and the second stubs 431, 432 on the front of the substrate 400. Referring to FIG. 9, the second power feeding part 442 is configured as a hexagon. In other words, the second power feeding part 442 is configured as a rectangular in an area distanced from a side contacting the edge of the substrate 400 by L5, and configured as a trapezoid in an area formed from L5 to L4. Accordingly, the width W4 in which the second power feeding part 442 contacts the first power feeding part 441 is relatively narrower than the width W6 in which the second power feeding part 442 contacts the edge of the substrate 400.

In FIGS. 8 through 10, the frequency of a stop band may be varied according to the width and/or the formation position of the first and the second stubs 431, 432 and the shape and/or size of the first and the second power feeding part 441, 442. Accordingly, the shapes, the sizes and the formation positions of the first and the second stubs 431, 432, the first power feeding part 441 and the second power feeding part 442 may be differently designed according to the application.

The size of each configuration member of the ultra wideband antenna according to the third exemplary embodiment of the present invention may be designed as indicated in Table 1.

TABLE 1

| | Parameter | | | | | | | | | | | | | | |
|---|---|---|---|---|---|---|---|---|---|---|---|---|---|---|---|
| | L1 | L2 | L3 | L4 | L5 | L6 | W1 | W2 | W3 | W4 | W5 | W6 | SL | SW1 | SW2 |
| Size (mm) | 26 | 14 | 8 | 6.3 | 2 | 3 | 30 | 21.8 | 0.5 | 0.2 | 0.5 | 3.2 | 7.55 | 0.3 | 0.4 |

In Table 1, L1 and W1 refer to the vertical and horizontal lengths of the ultra wideband antenna, respectively. L2 and W2 refer to the vertical and horizontal lengths of the hole 410, respectively. L4 refers to the vertical length of the portion of the trapezoid form of the second power feeding part 442, L5 refers to the vertical length of the vertical length of the portion of the rectangular form of the second power feeding part 442, and L6 refers to the distance between the arms of the first power feeding part 441. W3 refers to the width of the arm, W4 refers to the width of the second power feeding part 442 contacting the first power feeding part 441, W5 refers to the width of the first power feeding part 441 contacting the second power feeding part 442 and W6 refers to the width of the second power feeding part 442 contacting the edge of the substrate 400. SL refers to the lengths of the first and the second stubs 431, 432, SW1 refers to the widths of the first and the second stubs 431, 432 and SW2 refers to the distance between the metal layer 420 and each of the first and the second stubs 431, 432.

Figure 11:
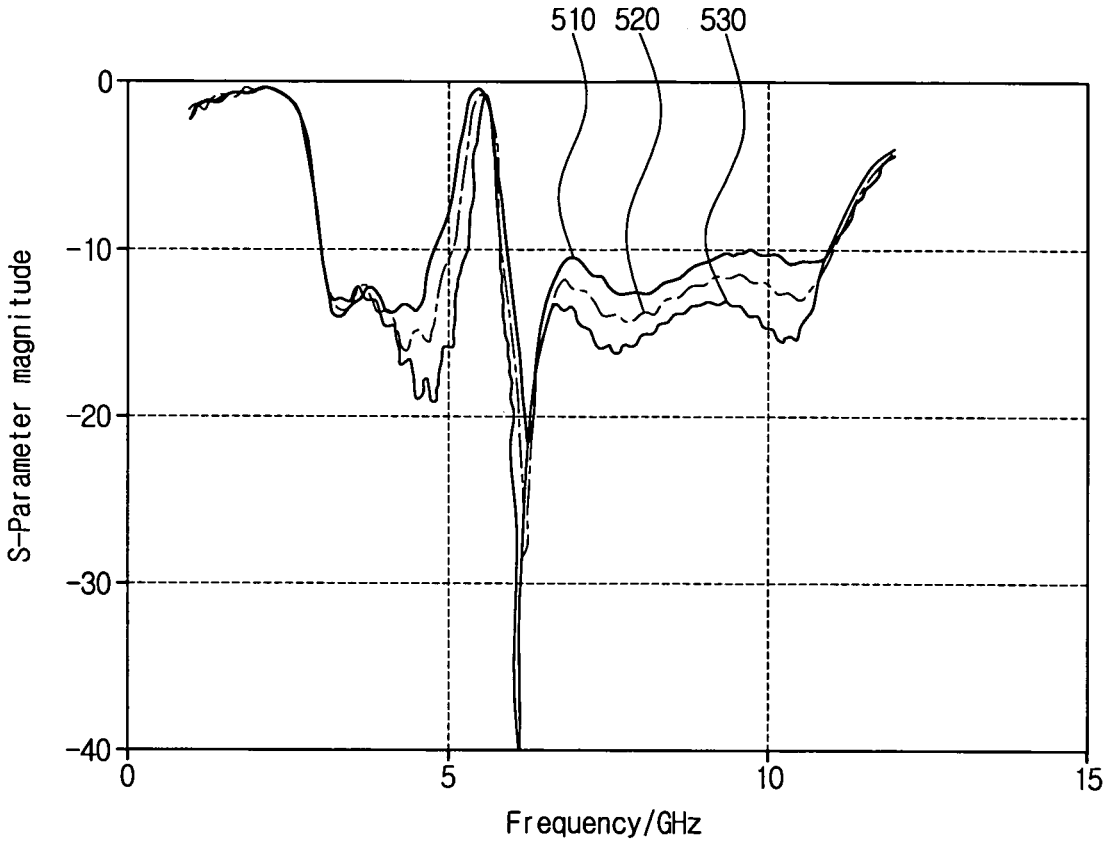
FIGS. 11 through 13 are S-parameter graphs for explaining a frequency characteristic of an ultra wideband antenna according to a third exemplary embodiment of the present invention.
Figure 12:
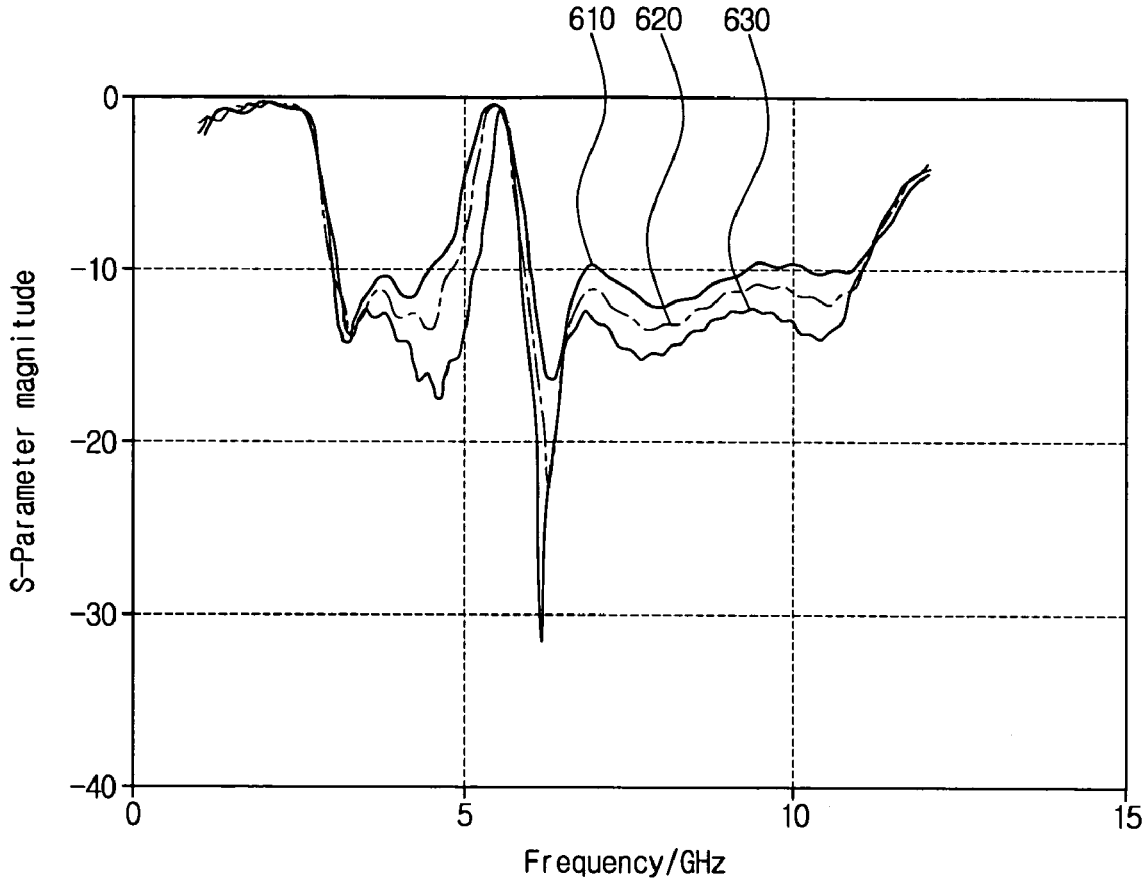
Figure 13:
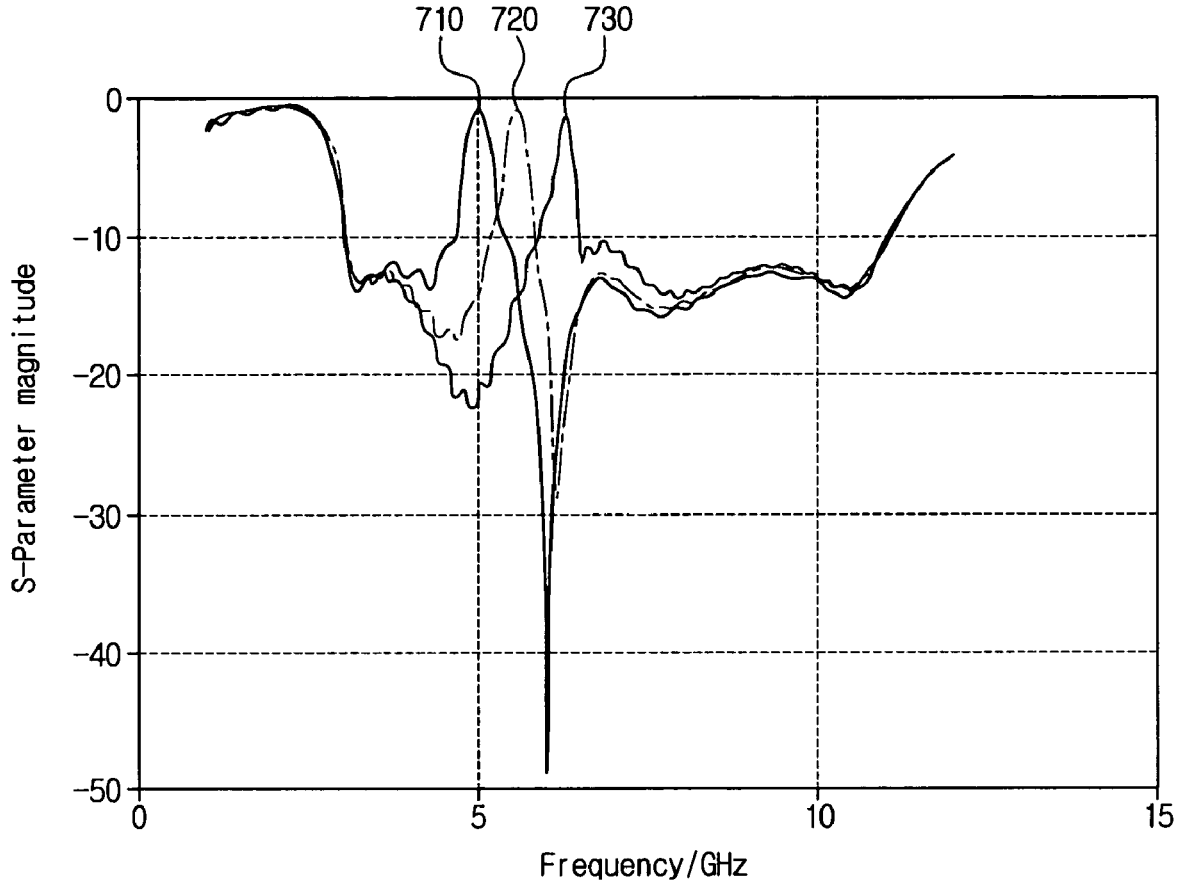

FIGS. 11 through 13 are S-parameter graphs for explaining the frequency characteristic of the ultra wideband antenna according to the third exemplary embodiment of the present invention. In FIGS. 11 through 13, the horizontal axis refers to a frequency [GHz], and the vertical axis refers to the S-parameter magnitude [dB].

FIG. 11 shows the characteristic of the width changes of the stop band of the ultra wideband antenna designed according to Table 1 when SW1 value is varied. The first graph 510 shows the frequency characteristic measured when SW1 is 1.0 mm, the second graph 520 shows the frequency characteristic measured when SW1 is 0.6 mm and the third graph 530 shows the frequency characteristic measured when SW1 is 0.2 mm. In each graph 510, 520, 530, the frequency band having S-parameter magnitude greater than −10 dB refers to the stop band. Referring to each graph 510, 520, 530, the stop band is 4.97-5.94 GHz band when SW1 is 1.0 mm, the stop band is 5.12-5.87 GHz when SW1 is 0.6 mm, and the stop band is 5.28-5.82 GHz when SW1 is 0.2 mm. As can be seen from FIG. 11, the stop band width becomes narrower as the SW1 value decreases. With reference to the data, the width of the stubs 431, 432 is adjusted so that the stop band width can be adjusted according to a particular application.

FIG. 12 shows the characteristic of the width changes of the stop band of the ultra wideband antenna designed according to Table 1 when SW2 value is varied. The first graph 610 shows the status when SW2 is 1.2 mm, the second graph 620 shows the status when SW2 is 0.8 mm and the third graph 630 shows the status when SW2 is 0.4 mm. Referring to each graph 610, 620, 630, the stop band is 4.54-6.06 GHz band when SW2 is 1.2 mm, the stop band is 4.83-5.95 GHz when SW2 is 0.8 mm, and the stop band is 5.17-5.87 GHz when SW2 is 0.4 mm. As can be seen from FIG. 12, the stop band width becomes narrower as the SW2 value decreases. With reference to the data, the width of the stubs 431, 432 is adjusted so that the stop band width can be adjusted according to a particular application.

FIG. 13 shows the characteristic of the width changes of the intermediate frequency of the ultra wideband antenna designed according to Table 1 when SL value is varied. The first graph 710 shows the status when SL is 8.5 mm, the second graph 720 shows the status when SL is 7.5 mm and the third graph 730 shows the status when SL is 6.5 mm. Referring to each graph 710, 720, 730, the intermediate frequency is 5.03 GHz band when SL is 8.5 mm, the intermediate frequency is 5.53 GHz when SL is 7.5 mm, and the intermediate frequency is 6.12 GHz when SL is 6.5 mm. As can be seen from FIG. 13, the intermediate frequency value becomes greater as the SL value decreases. With reference to the data, the length of the stubs 431, 432 is adjusted so that the stop band width can be set according to a particular application. As described above, the position, the width and the length of the stubs 431, 432 are adjusted so that the stop band width can be designed.

As described above, according to aspects of the present invention, the ultra wideband antenna having even the filter function can be implemented by a simple structure. Thus, the filter can be removed from an RF front end of the ultra wideband receiving system. As a result, a small ultra wideband receiving system can be implemented, and the power loss and noise characteristics can be improved. In addition, the constituent elements of the receiving system can be integrated and its manufacturing process can be simplified to improve the economical efficiency of the system.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An ultra wideband antenna comprising:

a power feeding part which receives a supply of an external electromagnetic energy;

a radiator which is excited by the electromagnetic energy fed through the power feeding part and radiates an electromagnetic wave; and a stub, disposed on the radiator in a direction which is parallel to a direction of an electric field of the electromagnetic wave which is radiated, which intercepts transmission or reception of a predetermined frequency band signal, wherein the power feeding part is formed in a multi-arm structure having a plurality of branches.

2. The ultra wideband antenna as claimed in claim 1, wherein the radiator comprises:

a substrate;

a first metal layer disposed on the substrate;

a second metal layer disposed on the substrate; and a taper slot, disposed on the substrate such that the taper slot gradually widens in a radiation direction of the electromagnetic wave, which divides the first metal layer and the second metal layer from each other.

3. The ultra wideband antenna as claimed in claim 2, wherein the first metal layer and the second metal layer are deposited on the substrate and the taper slot is formed on the substrate to divide the first metal layer and the second metal layer.

4. The ultra wideband antenna as claimed in claim 2, wherein the stub comprises:

a first stub disposed on the first metal layer, which includes one end that is open in a direction of the taper slot, and a length of ¼ wavelength of an intermediate frequency signal in the predetermined frequency band; and a second stub disposed on the second metal layer, which includes one end that is open in a direction of the taper slot, and a length of ¼ wavelength of an intermediate frequency signal in the predetermined frequency band.

5. The ultra wideband antenna as claimed in claim 4, wherein the power feeding part comprises:

a lower feeding part, disposed on a lower surface of the substrate, which receives the supply of the electromagnetic energy; and an upper feeding part, which is provided as a pattern in a predetermined shape of the first metal layer and the second metal layer, which couples the electromagnetic energy.

6. The ultra wideband antenna as claimed in claim 4, wherein the lower feeding part is formed on the lower surface of the substrate and the upper feeding part is formed in the first metal layer and the second metal layer as a pattern in the predetermined shape.

7. The ultra wideband antenna as claimed in claim 5, wherein the power feeding part comprises the lower feeding part and the upper feeding part, which are each formed in the multi-arm structure.

8. The ultra wideband antenna as claimed in claim 1, wherein the radiator comprises:

a substrate;

a metal layer, disposed on the substrate in a circular shape, which omnidirectionally radiates the electromagnetic wave; and a coplanar waveguide (CPW) line which transfers the electromagnetic energy coupled by the power feeding part to the metal layer.

9. The ultra wideband antenna as claimed in claim 8, wherein the stub comprises:

a first stub disposed on a left side of the metal layer with respect to the CPW line, said first stub having a length of ¼ wavelength of an intermediate frequency signal in the predetermined frequency band; and a second stub disposed on a right side of the metal layer with respect to the CPW line, said second stub having a length of ¼ wavelength of an intermediate frequency signal in the predetermined frequency band.

10. The ultra wideband antenna as claimed in claim 1, wherein the radiator comprises:

a substrate; and a metal layer disposed on an edge of an upper surface of the substrate such that a predetermined area of the upper surface of the substrate is exposed to provide a hole.

11. The ultra wideband antenna as claimed in claim 10, wherein the power feeding part is disposed on a lower surface of the substrate.

12. The ultra wideband antenna as claimed in claim 11, wherein the metal layer is connected to an external ground terminal and the metal layer radiates the electromagnetic energy via the hole if the electromagnetic energy is supplied via the power feeding part.

13. The ultra wideband antenna as claimed in claim 12, wherein the stub comprises:

a first stub disposed in the hole of the substrate, wherein a first end of the first stub contacts the metal layer and a second end of the first stub is open in a direction inward of the hole; and a second stub disposed in the hole of the substrate, wherein a first end of the second stub contacts the metal layer and a second end of the second stub is open in a direction inward of the hole and parallel with the first stub, wherein lengths of the first stub and the second stub, respectively, are ¼ wavelength of a intermediate frequency signal in the predetermined frequency band.

14. The ultra wideband antenna as claimed in claim 13, wherein the power feeding part comprises:

a first power feeding part disposed on a central area of the lower surface of the substrate, said first power feeding part having a multi-arm structure; and a second power feeding part which extends from an edge to the central area of the lower surface of the substrate to connect to the first power feeding part.

15. A system for receiving an ultra wideband signal, comprising:

an antenna which receives an ultra wideband signal except for a predetermined frequency band signal within an ultra wideband frequency range;

a matching unit which matches an impedance of the antenna to a predetermined level; and an amplifying unit which amplifies the signals which are received through the antenna, wherein the antenna comprises:

a radiator which radiates an electromagnetic wave in a predetermined direction;

at least one stub provided on the radiator in a direction parallel to a direction of an electric field of the electromagnetic wave, said at least one stub having a length of a ¼ wavelength of an intermediate frequency signal in the frequency band; and a power feeding part which supplies an external electromagnetic energy to the radiator, and wherein the power feeding part is formed in a multi-arm structure having a plurality of branches.

* * * * *